US010134346B2

(12) United States Patent
Wang

(10) Patent No.: US 10,134,346 B2
(45) Date of Patent: Nov. 20, 2018

(54) DISPLAY DEVICE

(71) Applicant: BOE TECHNOLOGY GROUP CO., LTD., Beijing (CN)

(72) Inventor: Zhicheng Wang, Beijing (CN)

(73) Assignee: BOE Technology Group Co., Ltd, Beijing (CN)

( * ) Notice: Subject to any disclaimer, the term of this patent is extended or adjusted under 35 U.S.C. 154(b) by 188 days.

(21) Appl. No.: 15/200,173

(22) Filed: Jul. 1, 2016

(65) Prior Publication Data

US 2017/0243551 A1 Aug. 24, 2017

(30) Foreign Application Priority Data

Dec. 18, 2016 (CN) ..... 2016 1 0090298

(51) Int. Cl.
*G09G 3/36* (2006.01)

(52) U.S. Cl.
CPC ..... *G09G 3/3614* (2013.01); *G09G 2300/04* (2013.01); *G09G 2310/08* (2013.01); *G09G 2330/021* (2013.01)

(58) Field of Classification Search
CPC . G06F 3/033; G06F 3/02; G06F 3/041; G06F 3/045; G09G 5/08; G09G 5/00; G09G 3/36; G01R 27/26
See application file for complete search history.

(56) References Cited

U.S. PATENT DOCUMENTS 5,422,854 A * 6/1995 Hirano ..... G11C 16/28 365/185.21
2009/0116154 A1* 5/2009 Kim ..... H03K 17/168 361/18
2014/0111494 A1* 4/2014 Su ..... G09G 3/3614 345/209
2014/0232624 A1* 8/2014 Kim ..... G09G 3/3696 345/87

(Continued)

FOREIGN PATENT DOCUMENTS

CN 101334975 12/2008
CN 103293731 9/2013

(Continued)

OTHER PUBLICATIONS

Office Action from corresponding Chinese Application No. 201610090298.9 dated Aug. 28, 2017 (7 pages).

*Primary Examiner* — Pegeman Karimi
(74) *Attorney, Agent, or Firm* — Harness, Dickey & Pierce, P.L.C.

(57) ABSTRACT

A display driving circuit includes a storage module, a switch module and a current detection module. The storage module is configured to store a control program of inversion driving modes for liquid crystal and output to the switch module an inversion drive signal corresponding to different inversion driving modes for liquid crystal. The current detection module is configured to detect a change in current and output a current detection signal corresponding to the switch module based on a magnitude of the detected current value. The (Continued)

switch module is configured to determine a desired inversion driving mode for liquid crystal based on the current detection signal and output an inversion driving signal corresponding to the desired inversion driving mode for liquid crystal.

20 Claims, 2 Drawing Sheets

(56) References Cited

U.S. PATENT DOCUMENTS

| | | | | |
|---|---|---|---|---|
| 2015/0102989 | A1* | 4/2015 | Lee | G09G 3/3614 345/96 |
| 2015/0355488 | A1* | 12/2015 | Wang | G09G 3/3614 349/37 |

FOREIGN PATENT DOCUMENTS

| | | |
|---|---|---|
| CN | 104064155 | 9/2014 |
| CN | 105304051 | 2/2016 |

* cited by examiner

DISPLAY DEVICE

CROSS-REFERENCE TO RELATED APPLICATION

This application claims the benefit and priority of Chinese Patent Application No. 201610090298.9 filed Feb. 18, 2016. The entire disclosure of the above application is incorporated herein by reference.

FIELD

The present disclosure relates to the field of display technologies, and particularly, to a display driving circuit, a display device having the display driving circuit and a display driving method.

BACKGROUND

This section provides background information related to the present disclosure which is not necessarily prior art.

With the continuous development of display technologies, in order to prevent solidification of the liquid crystal in the operation from damaging liquid crystal molecules, the voltage of the pixel electrode and the common electrode always changes in the operation. Since the voltage of the common electrode always changes, the screen flickers. To prevent the screen flicker, it needs to ensure that polarity of drive power of adjacent pixels is opposite, whereby there develops a plurality of inversion driving modes for liquid crystal, such as dot inversion driving mode and column inversion driving mode.

Currently in the inversion driving modes abovementioned, the dot inversion driving mode has the best screen display effect. However, higher power consumption of the dot inversion driving mode easily leads to excessive power. The column inversion driving mode has lower power consumption. Therefore, with the screen display quality to be ensured, how to control power consumption by switching the inversion driving mode becomes a concern to those skilled in the art.

SUMMARY

This section provides a general summary of the disclosure, and is not a comprehensive disclosure of its full scope or all of its features.

The embodiment of present disclosure provides a display driving circuit comprising a storage module, a switch module and a current detection module, wherein the storage module is connected with the switch module, and is configured to store control program of inversion driving modes for liquid crystal and output to the switch module an inversion drive signal corresponding to different inversion driving modes for liquid crystal;

the current detection module is connected with the switch module, and is configured to detect the change in current and output a current detection signal corresponding to the switch module based on the magnitude of the current value; and the switch module is configured to determine an desired inversion driving mode for liquid crystal based on the current detection signal and output an inversion driving signal corresponding to the desired inversion driving mode for liquid crystal.

According to a further embodiment of the present disclosure, the storage module comprises a first memory and a second memory respectively connected to the switch module, the first memory being configured to store control program of a column inversion driving mode and output to the switch module a column inversion driving signal corresponding to the column inversion driving mode, the second memory being configured to store control program of a dot inversion driving mode and output to the switch module a dot inversion driving signal corresponding to the dot inversion driving mode.

According to a further embodiment of the present disclosure, at least one of the first memory and the second memory is an electrically erasable programmable read-only memory.

According to a further embodiment of the present disclosure, the column inversion driving signal comprises a first data signal, a first clock signal and a first common electrode signal, and the dot inversion driving signal comprises a second data signal, a second clock signal and a second common electrode signal.

According to a further embodiment of the present disclosure, one of the first common electrode signal and the second common electrode signal is output by a GAMA chip and the other common electrode signal is directly output.

According to a further embodiment of the present disclosure, the current detection signal is a high-level signal when the detected current value is greater than a first predetermined threshold value, and the current detection signal is a low-level signal when the detected current value is equal to or less than the first predetermined threshold value.

According to a further embodiment of the present disclosure, the current detection module is a current detection comparator.

According to a further embodiment of the present disclosure, the switch module comprises a first switching element, a second switching element, a third switching element and a fourth switching element;

wherein the control terminal of the first switching element is coupled to the current detection module, the first terminal of the first switching element is grounded, and the second terminal of the first switching element is coupled to the control terminal of the fourth switching element;

the control terminal of the second switching element is coupled to the control terminal of the fourth switching element, the first terminal of the second switching element is coupled to the first memory, and the second terminal of the second switching element is coupled to the output terminal of the switch module;

the control terminal of the third switching element is coupled to the second terminal of the fourth switching element, the second terminal of the third switching element is coupled to the second memory, and the first terminal of the third switching element is coupled to the output terminal of the switch module; and the first terminal of the fourth switching element is coupled to the first memory.

According to a further embodiment of the present disclosure, the first switching element, the second switching element and the third switching elements all are transistors, and the fourth switching element is a triode.

According to a further embodiment of the present disclosure, the first switching element is an N-type transistor, and the second switching element and the third switching element are P-type transistors.

According to a further embodiment of the present disclosure, the first switching element is a P-type transistor, and the second switching element and the third switching element are N-type transistors.

According to a further embodiment of the present disclosure, the output terminal of the switch module is connected to a timing control driving circuit.

The disclosed embodiments also provide a display device comprising a display driving circuit, the display driving circuit comprising a storage module, a switch module and a current detection module, wherein the storage module is connected with the switch module, and is configured to store control program of inversion driving modes for liquid crystal and output to the switch module an inversion drive signal corresponding to different inversion driving mode for liquid crystal;

the current detection module is connected with the switch module, and is configured to detect the change in current and output a current detection signal corresponding to the switch module based on the magnitude of the current value;

the switch module is configured to determine an desired inversion driving mode for liquid crystal based on the current detection signal and output an inversion driving signal corresponding to the desired inversion driving mode for liquid crystal.

According to a further embodiment of the present disclosure, the storage module comprises a first memory and a second memory respectively connected to the switch module, the first memory being configured to store control program of a column inversion driving mode and output to the switch module a column inversion driving signal corresponding to the column inversion driving mode, the second memory being configured to store control program of a dot inversion driving mode and output to the switch module a dot inversion driving signal corresponding to the dot inversion driving mode.

According to a further embodiment of the present disclosure, the current detection signal is a high-level signal when the detected current value is greater than a first predetermined threshold value, and the current detection signal is a low-level signal when the detected current value is equal to or less than the first predetermined threshold value.

According to a further embodiment of the present disclosure, the switch module comprises a first switching element, a second switching element, a third switching element and a fourth switching element;

the control terminal of the first switching element is coupled to the current detection module, the first terminal of the first switching element is grounded, and the second terminal of the first switching element is coupled to the control terminal of the fourth switching element;

the control terminal of the second switching element is coupled to the control terminal of the fourth switching element, the first terminal of the second switching element is coupled to the first memory, and the second terminal of the second switching element is coupled to the output terminal of the switch module;

the control terminal of the third switching element is coupled to the second terminal of the fourth switching element, the second terminal of the third switching element is coupled to the second memory, and the first terminal of the third switching element is coupled to the output terminal of the switch module; and the first terminal of the fourth switching element is coupled to the first memory.

According to a further embodiment of the present disclosure, the first switching element, the second switching element and the third switching elements all are transistors, and the fourth switch element is a triode.

According to a further embodiment of the present disclosure, the output terminal of the switch module is connected to a timing control driving circuit.

The disclosed embodiments also provide a display driving method for a display device, the display device having a display driving circuit, the display driving circuit comprising a storage module, a switch module and a current detection module, the display driving method comprising the steps of:

outputting to the switch module via the storage module an inversion driving signal corresponding to different inversion driving modes for liquid crystal, wherein the storage module stores control program of inversion driving modes for liquid crystal;

detecting the change in current by the current detection module, and outputting a corresponding current detection signal to the switch module based on the magnitude of the current value;

determining an desired inversion driving mode for liquid crystal by the switch module based on the current detection signal, and outputting an inversion driving signal corresponding to the desired inversion driving mode for liquid crystal.

According to a further embodiment of the present disclosure, the current detection signal is a high-level signal when the detected current value is greater than a first predetermined threshold value, and the current detection signal is a low-level signal when the detected current value is equal to or less than the first predetermined threshold value.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Those skilled in the art will appreciate that the terms used herein are only for the purpose of describing particular embodiments and are not intended to limit the disclosure. As used herein, the singular forms "a", "an" and "the" are intended to comprise the plural forms as well, unless expressly stated in other cases. It should be further understood that when the terms "include", "comprise", "including" and/or "comprising" are used in this specification, they refer to the elements and/or parts that exist but do not exclude the presence or addition of one or more other elements, parts and/or combinations thereof.

Unless otherwise defined, all terms (comprising technical and scientific terms) used herein have the same meaning commonly understood by those skilled in the art where the disclosed subject matter belongs. It will be further understood that terms, such as those defined in commonly used dictionaries, should be interpreted as the meanings consistent with their meanings in the context of the description and the related art, and will not be explained in an idealized or overly formal form, unless otherwise explicitly defined herein. As used herein, the statement "connecting" or "coupling" two or more parts together shall mean that the parts are directly combined together or combined through one or more intermediate components.

Figure 1:
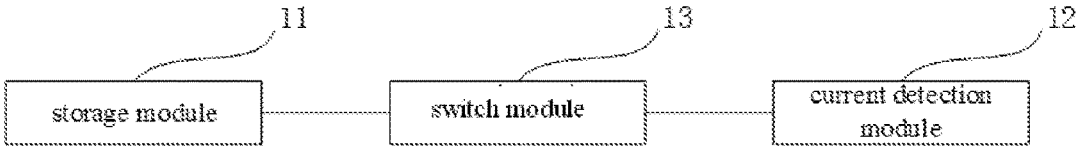
FIG. 1 is an exemplary block diagram of a display driving circuit of a display device according to an embodiment of the present disclosure.

FIG. 1 is an exemplary block diagram of a display driving circuit for a display device according to an embodiment of the present disclosure. As shown in FIG. 1, the display driving circuit comprises a storage module 11, a current detection module 12 and a switch module 13.

Wherein the storage module 11 is connected with the switch module 13, and is configured to store control program of an inversion driving mode for liquid crystal and output to the switch module 13 an inversion drive signal corresponding to different inversion driving modes for liquid crystal; the current detection module 12 is connected with the switch module 13, and is configured to detect current and output a corresponding current detection signal to the switch module 13 based on the magnitude of the current value; the switch module 13 is configured to determine an desired inversion driving mode for liquid crystal based on the current detection signal and output an inversion driving signal corresponding to the desired inversion driving mode for liquid crystal.

Figure 2:
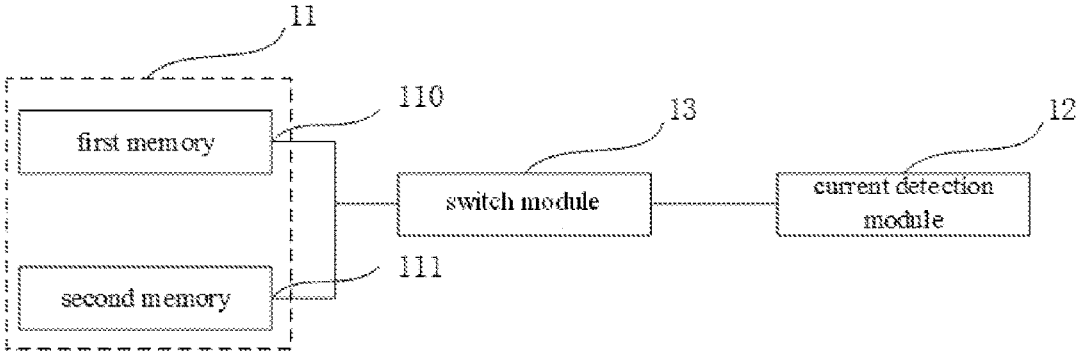
FIG. 2 is an exemplary block diagram of a display driving circuit of a display device according to a further embodiment of the present disclosure.

As shown in FIG. 2, the storage module 11 comprises a first memory 110 and a second memory 111. Wherein the first memory and the second memory may be electrically erasable programmable read-only memories (EEPROM). The first memory 110 is connected to the switch module 13, and is configured to store control program of a column inversion driving mode and output to the switch module 13 a column inversion drive signal corresponding to the column inversion driving mode. The second memory 111 is also connected to the switch module 13, and is configured to store control program of a dot inversion driving mode and output to the switch module 13 a dot inversion drive signal corresponding to the dot inversion driving mode.

In current T-con (Timing-Controller) driving circuit designs, control program of timing is stored in an external EEPROM, whereby at least one of the first and second memories in the embodiment of the present disclosure employs an external EEPROM to store control program of the inversion driving mode for liquid crystal. Since the dot inversion driving mode has a better screen display effect, if the grayscale of the current screen is low and power consumption thereof is not large, the dot inversion driving mode is then employed to control liquid crystal molecules. Since human eyes are not very sensitive to high-grayscale screens, if the grayscale of the current screen is higher, the column inversion driving mode is then employed to control liquid crystal molecules to reduce power consumption.

In the disclosed embodiment, the first memory 110 outputs to the switch module 13 a column inversion driving signal corresponding to the column inversion driving mode, the column inversion driving signal comprising a data signal SDA1 and a clock signal SCL1, the second memory 111 outputs to the switch module 13 a dot inversion driving signal corresponding to the dot inversion driving mode, the dot inversion driving signal comprising a data signal SDA2 and a clock signal SCL2. In addition, the column inversion driving signal further comprises a common electrode signal VCOM1, and the dot inversion driving signal further comprises a common electrode signal VCOM2. Taking into account that in different inversion driving modes, the voltage of the common electrode has certain differences, the VCOM1 signal and the VCOM2 signal can take the way in which one of the signals is output by a GAMA chip and the other is directly output and the present disclosure will not describe it herein.

In the disclosed embodiment, the current detection module 12 may be a current detection comparator. When power consumption changes, since the input voltage is constant, thereby leading to a change in current, the focus is to detect the change in current. When the current value is greater than a first predetermined threshold value, the current detection module 12 outputs a high-level current detection signal. After the high-level current detection signal is input to the switch module 13, the output terminal of the switch module 13 outputs the SDA1, SCL1 and VCOM1 signals corresponding to the column inversion driving mode, thereby reducing power consumption. When the current value is less than or equal to the first predetermined threshold value, the current detection module 12 outputs a low-level current detection signal, the output terminal of the switch module 13 outputs the SDA2, SCL2 and VCOM2 signals corresponding to the dot inversion driving mode so that the display device switches to the dot inversion driving mode. Further, after the display device enters a low-grayscale screen, the current value is further reduced, and the current detection module 12 outputs a low-level current detection signal again, so that the display device remains in or switches to the dot inversion driving mode.

Figure 3:
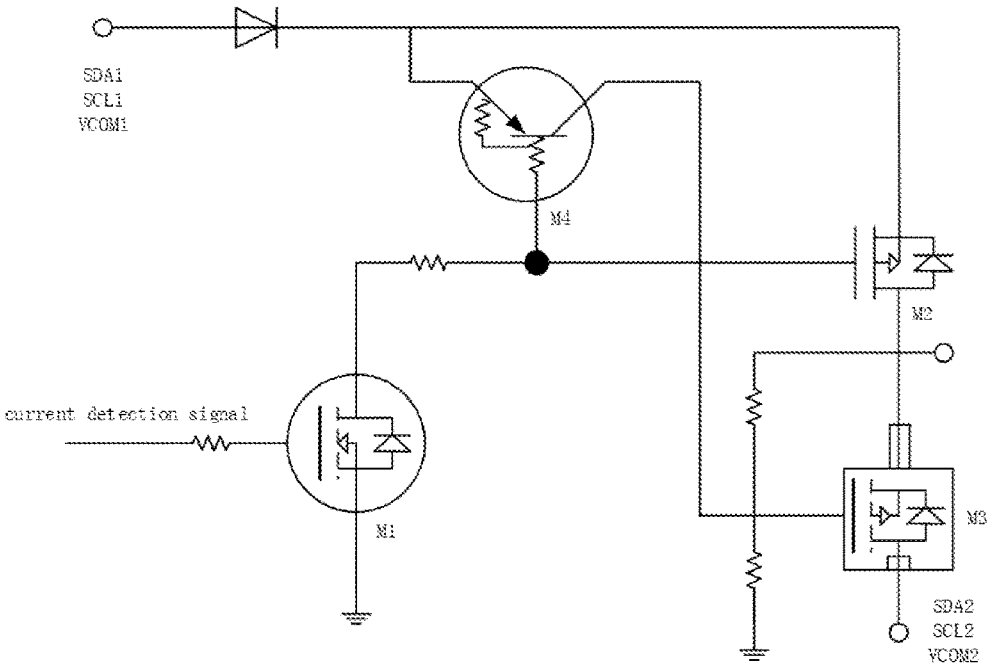
FIG. 3 is an exemplary circuit of a display driving circuit of a display device according to an embodiment of the present disclosure.

FIG. 3 is an exemplary circuit structure of the switch module 13 according to the embodiment of the present disclosure. The switch module 13 comprises a first switching element M1, a second switching element M2, a third switching element M3 and a fourth switching element M4, wherein the first switching element M1, the second switching element M2 and the third switching elements M3 are transistors, and the fourth switching elements M4 is a triode. It should be noted that the transistors used in the embodiment of the present disclosure may each be a thin film transistor or a field effect transistor or other device to implement the same function. According to the functions in the circuit, the transistors employed in the embodiment of the present disclosure may be switching transistors. For a field effect transistor, in the embodiment of the present disclosure, the control terminal represents the gate of the transistor, the first terminal represents the source of the transistor, and the second terminal represents a drain of the transistor. For a triode, the control terminal represents the base of the triode, the first terminal represents the emitter (E) of the triode, and the second terminal represents the collector (C) of the triode. Alternatively, the first switching element is an N-type transistor, and the second switching element and the third switching element are P-type transistors. Alternatively, the first switching element may be a P-type transistor, and the second switching element and the third switching element may be N-type transistors, and this will not be described in detail in the embodiment of the present disclosure.

In FIG. 3, the control terminal of the first switching element M1 is coupled to the current detection module 12, the first terminal of the first switching element M1 is grounded, and the second terminal of the first switching element M1 is coupled to the control terminal of the fourth switching element M4. The control terminal of the second switching element M2 is coupled to the control terminal of the fourth switching element M4, the first terminal of the second switching element M2 is coupled to the first memory 110, and the second terminal of the second switching element M2 is coupled to the output terminal of the switch module 13. The control terminal of the third switching element M3 is coupled to the second terminal of the fourth switching element M4, the second terminal of the third switching element M3 is coupled to the second memory 111, and the first terminal of the third switching element M3 is coupled to the output terminal of the switch module 13. The first terminal of the fourth switching element M4 is coupled to the first memory 110.

Figure 4:
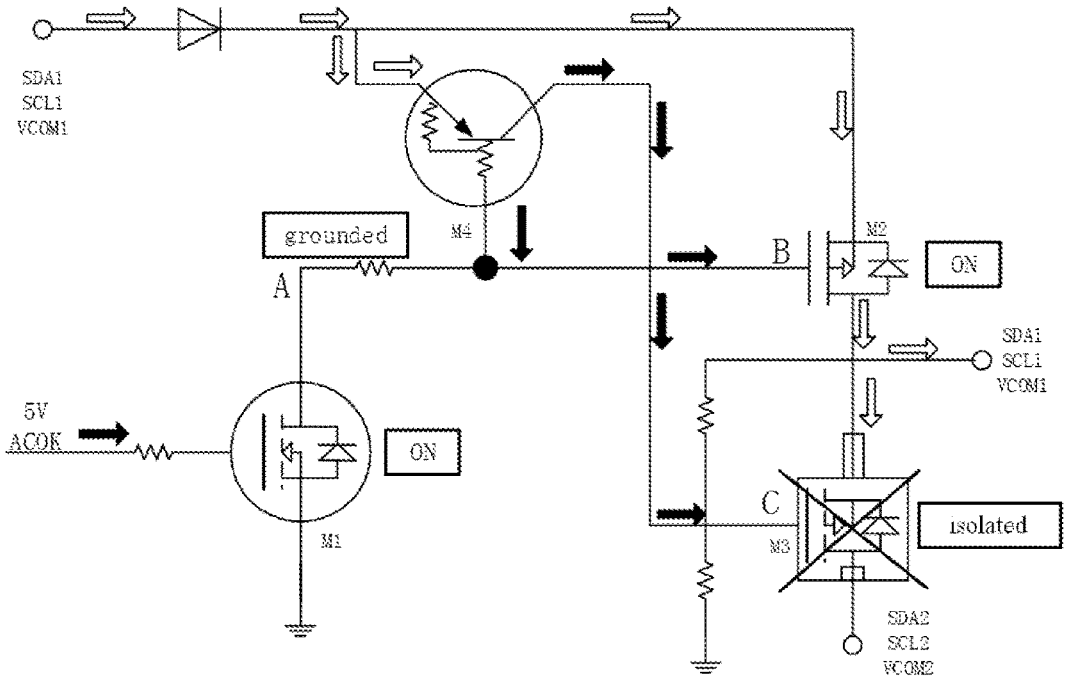
FIG. 4 is an exemplary circuit of the display driving circuit when the display device according to the embodiment of the present disclosure is in a column inversion driving mode.
Figure 5:
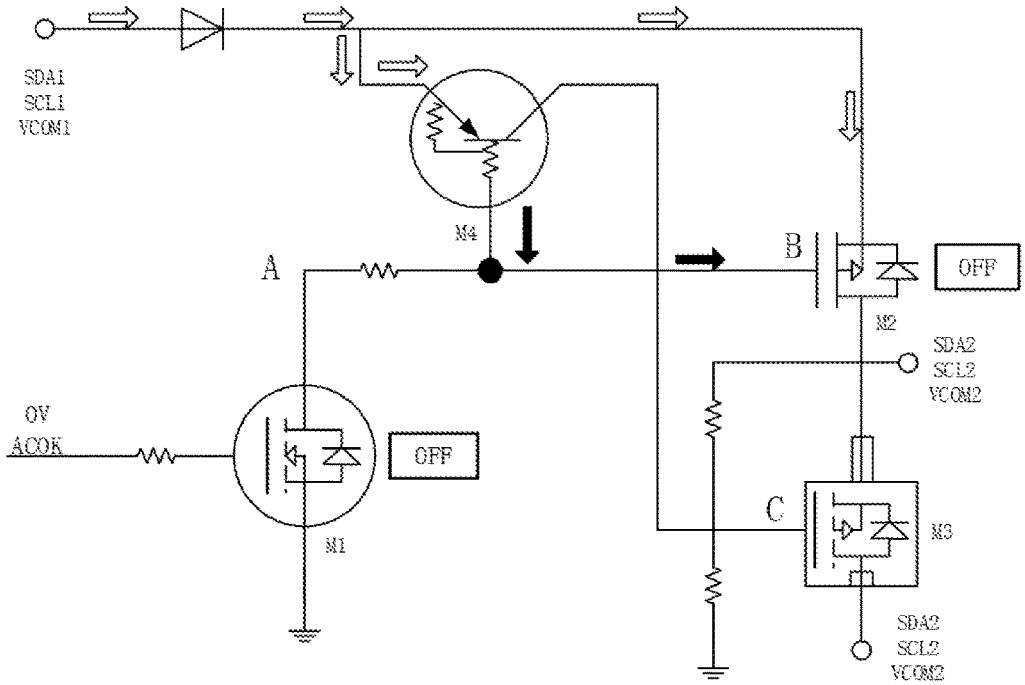
FIG. 5 is an exemplary circuit of the display driving circuit when the display device according to the embodiment of the present disclosure is in a dot inversion driving mode.

Now the work processes of the switch module 13 in the display driving circuit in different inversion driving modes are described in conjunction with FIGS. 4 and 5.

Referring to FIG. 4, after the switch module 13 receives a 5V high-level current detection signal outputted by the current detection module 12, the first switching element M1 is turned on. After the first switching element M1 is turned on, node A is grounded with voltage of 0V, whereby node B is at low level, so that the second switching element M2 is turned on. Since node A is grounded, the fourth switching element M4 is also in the ON state. After the fourth switching element M4 is turned on, node C is at high level, and the third switching element M3 is turned off, so that the dot inversion driving signals like SDA2, SCL2 and VCOM2 signals corresponding to the dot inversion driving mode cannot be outputted from the output terminal of the switch module 13. Since the second switching element M2 is in the ON state, the column inversion driving signals like SDA1, SCL1 and VCOM1 signals corresponding to the column inversion driving mode can be outputted from the output terminal of the switch module 13, so that the display device switches to be driven in the column inversion driving mode, reducing power consumption.

Referring to FIG. 5, after the switch module 13 receives a low-level current detection signal at 0V outputted by the current detecting module 12, the first switching element M1 is turned off. Since the first switching element M1 is turned off, node A and node B are no longer at low levels, at the time the second switching element M2 and the fourth switching element M4 both are in OFF state, so that the column inversion driving signals like SDA1, SCL1 and VCOM1 signals corresponding to the column inversion driving mode cannot be outputted from the output terminal of the switch module 13. Since the fourth switching element M4 is turned off, so that the control terminal of the third switching element M3 is at a low level, at the time the third switching element M3 is in ON state, so that the dot inversion driving signals like SDA2, SCL2 and VCOM2 signals corresponding to the dot inversion driving mode can be outputted from the output terminal of the switch module 13, so that the display device switches to be driven in the dot inversion driving mode.

In addition, the output terminal of the switch module 13 is connected to the timing control driving circuit. It should be noted that, during the process of the switch module 13 controlling the display device to be quickly switched between the inversion driving modes, the reset of the timing control driving circuit can be implemented by itself once, that is, addressing access of new Timing code can be implemented after the switching, and the duration of the entire process is less than 16.7 ms, so that human eyes cannot distinguish the entire switching procedure, thereby ensuring that the switching procedure is transparent to users.

Under the premise of ensuring the screen display quality and when power consumption is large, the technical solution provided in the embodiments of present disclosure controls the power consumption of the display device by switching the liquid crystal inversion driving modes, which can ensure that the screen state in the entire process of signal transmission is more suitable for human eyes, with low power consumption.

Those of ordinary skill in the art shall appreciate that all or part of the steps mentioned in the above-described embodiments may be accomplished by hardware, and may also be accomplished by hardware relevant to program instructions. The program may be stored in a computer-readable storage medium, which storage medium may be a read-only memory, a hard disk or an optical disk.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A display driving circuit comprising;

a storage module;

a switch module; and a current detection module, wherein:

the storage module is connected with the switch module, and is configured to store a control program of inversion driving modes for liquid crystal and output to the switch module an inversion drive signal corresponding to different inversion driving modes for liquid crystal;

the current detection module is connected with the switch module, and is configured to detect a change in current and output a current detection signal corresponding to the switch module based on a magnitude of the detected current value; and the switch module is configured to determine a desired inversion driving mode for liquid crystal based on the current detection signal and output an inversion driving signal corresponding to the desired inversion driving mode for liquid crystal.

2. The display driving circuit according to claim 1, wherein the storage module comprises a first memory and a second memory respectively connected to the switch module, the first memory is configured to store a control program of a column inversion driving mode and output to the switch module a column inversion driving signal corresponding to the column inversion driving mode, and the second memory is configured to store a control program of a dot inversion driving mode and output to the switch module a dot inversion driving signal corresponding to the dot inversion driving mode.

3. The display driving circuit according to claim 2, wherein at least one of the first memory and the second memory is an electrically erasable programmable read-only memory.

4. The display driving circuit according to claim 2, wherein the column inversion driving signal comprises a first data signal, a first clock signal and a first common electrode signal, and the dot inversion driving signal comprises a second data signal, a second clock signal and a second common electrode signal.

5. The display driving circuit according to claim 4, wherein one of the first common electrode signal and the second common electrode signal is output by a GAMA chip and the other common electrode signal is directly output.

6. The display driving circuit according to claim 2, wherein the switch module comprises a first switching element, a second switching element, a third switching element and a fourth switching element;

wherein a control terminal of the first switching element is coupled to the current detection module, a first terminal of the first switching element is grounded, and a second terminal of the first switching element is coupled to a control terminal of the fourth switching element;

a control terminal of the second switching element is coupled to the control terminal of the fourth switching element, a first terminal of the second switching element is coupled to the first memory, and a second terminal of the second switching element is coupled to an output terminal of the switch module;

a control terminal of the third switching element is coupled to a second terminal of the fourth switching element, a second terminal of the third switching element is coupled to the second memory, and a first terminal of the third switching element is coupled to the output terminal of the switch module; and a first terminal of the fourth switching element is coupled to the first memory.

7. The display driving circuit according to claim 6, wherein the first switching element, the second switching element and the third switching element are each transistors, and the fourth switch element is a triode.

8. The display driving circuit according to claim 7, wherein the first switching element is an N-type transistor, and the second switching element and the third switching element are P-type transistors.

9. The display driving circuit according to claim 7, wherein the first switching element is a P-type transistor, and the second switching element and the third switching element are N-type transistors.

10. The display driving circuit according to claim 1, wherein the current detection signal is a high-level signal when the detected current value is greater than a first predetermined threshold value, and the current detection signal is a low-level signal when the detected current value is equal to or less than the first predetermined threshold value.

11. The display driving circuit according to claim 1, wherein the current detection module is a current detection comparator.

12. The display driving circuit according to claim 1, wherein an output terminal of the switch module is connected to a timing control driving circuit.

13. A display device comprising a display driving circuit, the display driving circuit comprising:

a storage module;

a switch module; and a current detection module, wherein:

the storage module is connected with the switch module, and is configured to store a control program of inversion driving modes for liquid crystal and output to the switch module an inversion drive signal corresponding to different inversion driving modes for liquid crystal;

the current detection module is connected with the switch module, and is configured to detect a change in current and output a current detection signal corresponding to the switch module based on a magnitude of the detected current value; and the switch module is configured to determine a desired inversion driving mode for liquid crystal based on the current detection signal and output an inversion driving signal corresponding to the desired inversion driving mode for liquid crystal.

14. The display device according to claim 13, wherein the storage module comprises a first memory and a second memory each connected to the switch module, the first memory is configured to store a control program of a column inversion driving mode and output to the switch module a column inversion driving signal corresponding to the column inversion driving mode, and the second memory is configured to store a control program of a dot inversion driving mode and output to the switch module a dot inversion driving signal corresponding to the dot inversion driving mode.

15. The display device according to claim 13, wherein the current detection signal is a high-level signal when the detected current value is greater than a first predetermined threshold value, and the current detection signal is a low-level signal when the detected current value is equal to or less than the first predetermined threshold value.

16. The display device according to claim 13, wherein the switch module comprises a first switching element, a second switching element, a third switching element and a fourth switching element;

wherein a control terminal of the first switching element is coupled to the current detection module, a first terminal of the first switching element is grounded, and a second terminal of the first switching element is coupled to a control terminal of the fourth switching element;

a control terminal of the second switching element is coupled to the control terminal of the fourth switching element, a first terminal of the second switching element is coupled to the first memory, and a second terminal of the second switching element is coupled to an output terminal of the switch module;

a control terminal of the third switching element is coupled to a second terminal of the fourth switching element, a second terminal of the third switching element is coupled to the second memory, and a first terminal of the third switching element is coupled to the output terminal of the switch module; and a first terminal of the fourth switching element is coupled to the first memory.

17. The display device according to claim 16, wherein the first switching element, the second switching element and the third switching element are each transistors, and the fourth switch element is a triode.

18. The display device according to claim 13, wherein an output terminal of the switch module is connected to a timing control driving circuit.

19. A display driving method for a display device, wherein the display device includes a display driving circuit, the display driving circuit comprising a storage module, a switch module and a current detection module, the display driving method comprising:

outputting to the switch module by the storage module an inversion driving signal corresponding to different inversion driving modes for liquid crystal, wherein the storage module stores a control program of inversion driving modes for liquid crystal;

detecting a change in current by the current detection module, and outputting a current detection signal corresponding to the switch module based on a magnitude of the detected current value;

determining a desired inversion driving mode for liquid crystal by the switch module based on the current detection signal, and outputting an inversion driving signal corresponding to the desired inversion driving mode for liquid crystal.

20. The display driving method according to claim 19, wherein the current detection signal is a high-level signal when the detected current value is greater than a first predetermined threshold value, and the current detection signal is a low-level signal when the detected current value is equal to or less than the first predetermined threshold value.

* * * * *